US007387064B2

(12) United States Patent
Linnonmaa et al.

(10) Patent No.: US 7,387,064 B2
(45) Date of Patent: Jun. 17, 2008

(54) METHOD AND APPARATUS FOR PRODUCING CALENDERED PAPER

(75) Inventors: Pekka Linnonmaa, Järvenpää (FI); Hannu Lätti, Vantaa (FI); Markku Kyytsönen, Numminen (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/598,664

(22) PCT Filed: Mar. 11, 2005

(86) PCT No.: PCT/FI2005/050076

§ 371 (c)(1),
(2), (4) Date: Oct. 27, 2006

(87) PCT Pub. No.: WO2005/088009

PCT Pub. Date: Sep. 22, 2005

(65) Prior Publication Data

US 2007/0125245 A1 Jun. 7, 2007

Related U.S. Application Data

(60) Provisional application No. 60/552,936, filed on Mar. 12, 2004.

(51) Int. Cl.
*B30B 15/34* (2006.01)
*B30B 3/04* (2006.01)
*D21F 11/00* (2006.01)

(52) U.S. Cl. ..... 100/38; 100/74; 100/75; 100/161; 100/331; 162/207

(58) Field of Classification Search ..... 100/38, 100/41, 74, 92, 305, 327, 331, 333, 155 R, 100/161, 176, 73, 75, 162 R; 162/203, 204, 162/205, 206, 207
See application file for complete search history.

(56) References Cited

U.S. PATENT DOCUMENTS 4,642,164 A 2/1987 Hanhikoski et al.

(Continued)

FOREIGN PATENT DOCUMENTS

CA 2110786 9/1997

(Continued)

OTHER PUBLICATIONS

International Preliminary Report on Patentability issued in PCT/FI2005/050076.

(Continued)

*Primary Examiner*—Jimmy T. Nguyen
*Assistant Examiner*—Shauna L. Zimmerman
(74) *Attorney, Agent, or Firm*—Stiennon & Stiennon

(57) ABSTRACT

A paper web moistened in a paper machine and reeled on a machine reel is calendered in a multinip calender arranged apart from the paper machine, whose roll assembly is formed of a first set of rolls and a second set of rolls in the travel direction of the paper web. At least one surface of the paper web is moistened with at least one pre-moisturizer, whereafter the paper web is guided to the first calender nip of the first set of rolls and one surface of the paper web is moistened with at least one intermediate moisturizer, whereafter the paper web is guided to the first calender nip of the second set of rolls, wherein a paper web having a roughness of 1.0-1.1 μm and/or gloss of 54-57% or 56-60% is produced as a result of calendering.

12 Claims, 6 Drawing Sheets

U.S. PATENT DOCUMENTS

| | | | | |
|---|---|---|---|---|
| 5,065,673 | A | 11/1991 | Taylor et al. | |
| 5,163,365 | A | 11/1992 | Taylor | |
| 6,073,549 | A * | 6/2000 | Winheim et al. | 100/74 |
| 6,401,355 | B1 | 6/2002 | Linnonmaa et al. | |
| 6,500,305 | B1 | 12/2002 | Winheim et al. | |
| 6,698,342 | B1 | 3/2004 | Heikkinen et al. | |
| 6,758,135 | B2 | 7/2004 | Linnonmaa et al. | |
| 7,059,066 | B2 | 6/2006 | Maurer | |

FOREIGN PATENT DOCUMENTS

| | | | |
|---|---|---|---|
| DE | 3741680 | A1 | 6/1989 |
| EP | 0979897 | A2 | 2/2000 |
| EP | 0979897 | A3 | 5/2000 |
| EP | 1 335 066 | A1 | 8/2003 |
| FI | 100671 | B | 1/1998 |
| FI | 113072 | B | 2/2004 |
| WO | 0070146 | A2 | 11/2000 |
| WO | 0070146 | A3 | 11/2000 |
| WO | 0123666 | A2 | 4/2001 |
| WO | 0123666 | A3 | 4/2001 |
| WO | 01/55504 | A1 | 8/2001 |
| WO | 0175224 | A1 | 10/2001 |
| WO | 2004/001126 | A1 | 12/2003 |
| WO | 2005/088009 | A1 | 9/2005 |

OTHER PUBLICATIONS

International Search Report issued in PCT/FI2005/050076.

English Abstract of EP 1 335 066.

"Papermaking Part 3, Finishing", Papermaking Science and Technology Book 10, Fapet Oy © 1999.

International Preliminary Examination Report issued in PCT/FI03/00482.

International Search Report issued in PCT/FI03/00482.

* cited by examiner

METHOD AND APPARATUS FOR PRODUCING CALENDERED PAPER

CROSS REFERENCES TO RELATED APPLICATIONS

This application is a national stage application of International App. No. PCT/FI2005/050076, filed Mar. 11, 2005, the disclosure of which is incorporated by reference herein, and claims priority on U.S. Provisional Application No. 60/552,936, filed Mar. 12, 2004.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for producing calendered paper and an apparatus for implementing the aforementioned method.

After the drying of paper, the desired surface structure of the web is produced by means of a mechanical treatment of the surface of paper, i.e. calendering. There are many calendering methods, but it is characteristic to all of them that the web is led through one or several nips, which is/are formed between two rotating rolls that are pressed against each other. The purpose of the calendering is to improve the properties of a paper web, especially its thickness profile, smoothness, gloss as well as porosity and opacity of the surface. The formability of the paper web in the nip is affected by the temperature of the calender rolls, the nip pressure prevailing in the nip and the moisture content of the web. By adjusting these parameters it is possible to affect the above-mentioned physical properties of the paper web.

At present, the end users of paper demand paper grades of higher quality. The speeds of paper machines have also increased, which has resulted in rapid development of on-line calendering methods. However, on-line calendering methods are not suitable for production of high quality printing paper grades with especially high surface quality requirements, such as SC grades. These high quality paper grades must still be produced by using re-reeling and off-line multiroll or super calenders after the drying of the fiber web, wherein several, even three or four such calenders are used in parallel in one paper machine to satisfy the production capacity.

Supercalenders are calendering units in which nips are formed between a press roll having a smooth surface, such as a metal roll, and a roll provided with a flexible coating, such as a paper or polymer roll. Supercalenders typically comprise 10 to 12 nips of which one is a so-called reversing nip in which two rolls having a flexible surface are positioned against each other. By means of the reversing nip it is possible to treat both sides of the web to make them substantially similar. The supercalender rolls are conventionally arranged on top of each other, wherein they form a high stack of rolls.

Conventionally, SC grades are manufactured in such a manner that the paper is dried, "overdried" to a moisture content of approximately 2 to 4% in the drying section of the paper machine. Thereafter the paper is moistened to calendering moisture of 8 to 11% before reeling up. On the reel, the moisture of the paper has time to stabilize in the z-direction of the paper before supercalendering by means of the supercalender.

However, the moistening of paper to the above-mentioned moisture content causes problems. It is difficult to reel up such paper having a moisture content of 8 to 11% and to handle the paper reels as well. Problems are also caused by the shrinking of the web in the CD and/or MD direction resulting from the drying of the paper before calendering. The height of the stack of rolls in the supercalender sometimes also causes problems relating to space in a paper mill.

Normally, when paper is calendered the smoothening and glazing of its surface takes place at the expense of the thickness of paper. In the calender, linear load and/or nip pressure are/is used as a control variable, which determines the surface quality of the paper as well as the final thickness. In other words, when the aim is to attain good surface quality, the thickness of paper is reduced. Attempts have been made to solve this problem by means of so-called gradient calendering, in which paper is moistened right before calendering in such a manner that the moistening water has time to be absorbed only in the surface of the paper web, wherein the effect of calendering is exerted only on the surface layers of the web, and the calendering does not bring about changes in the density of the central parts of the web or a substantial change in the thickness of the web.

Gradient calendering has been applied in on-line calenders in which the paper web is guided directly without re-reeling from the drying section of the paper machine to a calender containing several nips, for example to a supercalender. Such a method is disclosed for example in U.S. Pat. No. 6,401,355, in which the web is overdried in the drying section of the paper machine and moistened again before it is guided to an on-line calender located in connection with the paper machine. The amount of moistening water and the absorption time of the water is selected in such a manner that the moistening water only affects the surface layers of the web. In U.S. Pat. No. 6,758,135 one side of the paper web is moistened with a first moisturizer before the web is guided to a supercalender, and the opposite side is moistened with a second moisturizer after the reversing nip of the supercalender. U.S. Pat. No. 6,698,342 also discloses the use of two moisturizers in connection with the calendering process, in which a multiroll calender is divided into two roll sets of rolls and a first moisturizer is positioned before the calender and a second, a so-called intermediate moisturizer is positioned between the set of rolls.

However, by means of the methods according to these publications it has not been possible to attain the high surface quality required of SC papers. Furthermore, the methods presented by these publications are only suitable for on-line calenders. In practice, moisture gradient calendering has not yet been applied in off-line multinip calenders.

SUMMARY OF THE INVENTION

Therefore, the purpose of the present invention is to provide a method for producing calendered paper, which method avoids the above-mentioned problems and in which moisture gradient calendering is applied in an off-line multinip calender.

The invention is based on the idea that a paper web is treated by means of an off-line multinip calender whose roll assembly is formed of two separate sets of rolls in the travel direction of the web, a first set of rolls and a second set of rolls. Before calendering, after the unwinding, the paper web to be treated is moistened with a pre-moisturizer to a moisture content of 8 to 12%, before the web is guided to the first calender nip of the first set of rolls 3. The paper web is moistened again by means of an intermediate moisturizer to a moisture content of 6 to 10%, before the web is guided to the first calender nip of the second set of rolls.

Before the paper web is guided to the multinip calender in connection with the web-making process, the paper has been moistened before the reeling up process to a moisture content of 1 to 10%, advantageously 4 to 7%, which is optimal in view of reeling. This makes both the reeling up in the paper machine and the unwinding in the calender easy. Furthermore, in this moisture content the reels are in balance with the ambient air, and therefore the changes in the MD and CD direction during the storage of paper and the transporting from the paper machine to the calender are less significant than the changes in reels moistened conventionally to a moisture content of 8 to 11%.

The pre-moisturizer positioned in the calender is composed of at least one moisturizer positioned between the unwinder of the calender and the first nip of the first set of rolls of the calender. The intermediate moisturizer is positioned between the first and the second set of rolls. The moisturizers are positioned in close proximity of the web, against the surface of the web in such a manner that the moistening medium coming therefrom hits the surface of the web. There may be two pre-moisturizers, one on each side of the web, and they can be positioned on both sides of the paper web, either at the same point against the web, on different sides of the web so that they substantially moisten the same point in the web, or in different locations on the web so that they moisten different points in the web.

The pre-moisturizers and intermediate moisturizers can be positioned asymmetrically at different points in the web with respect to each other so that the absorption time of the moistening water is substantially the same on both sides of the web. The absorption time indicates the time that it takes the web to move from the center line of the moisturizer extending across the width of the web to the first nip affecting said moistened side of the web. Thus, the moistened side of the web is brought against the surface of the heated roll. By using asymmetrically positioned moisturizers it is possible to attain the same absorption time of the moistening medium on both sides of the web. The absorption time is under 1.5 seconds, typically under 1 second.

The medium used in the moistening can be liquid, such as water, or vapor. If desired, it is also possible to use solutions of water-chemical mixtures. It is possible to select the composition of the solution in such a manner that it intensifies the effect of the moisture gradient technique and improves the properties of paper, such as brightness, opacity, surface strength, dimensional stability and moldability of the paper web and reduces the fouling of the calender rolls.

In web moistening it is possible to use any moistening devices suitable for this purpose, but it is most advantageous to use moisturizers having nozzles whose droplet size is under 100 μm. The moistening devices extend across the width of the web in such a manner that the entire width of the web is moistened. When desired, it is possible to use the moistening devices also for profiling of the web, wherein only some of the nozzles positioned across the width of the web are used for the moistening.

The moistening is adjusted by means of feedback control in which multivariable control and/or model-based predictive control are/is utilized. For the adjustment, the moisture of the paper web moving in the calender or another property of the same, such as roughness, gloss, porosity, brightness and opacity is measured either by fixed-point measurement sensors or scanning measurement sensors travelling back-and forth across the width of the web. The sensors are typically attached to a measurement beam extending across the width of the web, and there may be one or several such beams in the calender.

By means of the invention, it is possible to apply moisture gradient calendering in off-line multinip calenders. By means of the invention it is possible to reduce the number of calenders per paper machine, even reductions by two calenders are possible, which brings about savings in the investment costs of mills. The invention improves especially the properties of SC papers, especially their roughness and gloss can be raised to a level higher than before.

In the following, the invention will be described in more detail with reference to the appended drawings.

DESCRIPTION OF THE PREFERRED EMBODIMENTS

In FIGS. 1*a* to 6, the same numerals refer to corresponding parts and they will not be explained separately later on, unless required for clarification of the subject matter.

The figures show only a few embodiments of the apparatuses according to the invention. The number of calender nips depends on the quality of paper to be calendered and the running speed of the calender. Table 1 shows advantageous nip numbers to be used for different paper grades.

TABLE 1

| Paper grade | Number of calender nips |
|---|---|
| SC-A/SC-A+ | 4 + 4 or 5 + 5 |
| SC-B | 2 + 4 or 4 + 4 |
| SC-C/ improved newspaper | 2 + 2 or 2 + 4 |

In the table, the number of calender nips is the number of nips in the first set of rolls+the number of nips in the second set of rolls in a multinip calender.

Figure 1:
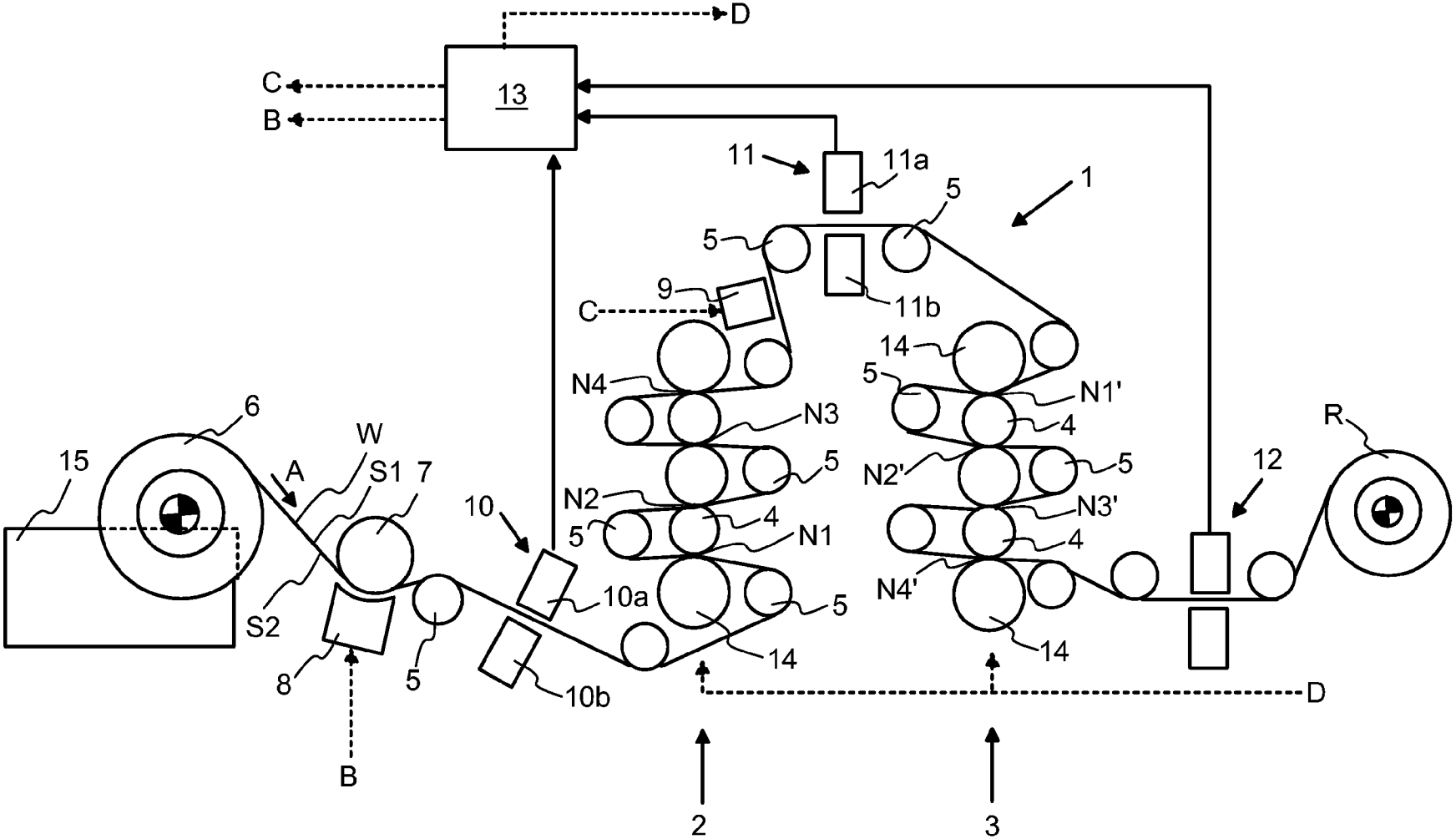
FIG. 1 shows a schematic side view of an apparatus according to the invention.

FIG. 1 shows an apparatus according to the invention, which comprises a multinip calender 1 consisting of two stacks of rolls, i.e. sets of rolls, a first set of rolls 2 and a second set of rolls 3. In both sets of rolls successive nips are formed between the superimposed rolls in the stack of calender rolls. Both sets of rolls 2 and 3 are formed of rolls 14 having a flexible coating, such as paper or polymer rolls, heated metal rolls 4 having a smooth surface following each other alternately in the machine direction, and reversing and guide rolls 5 guiding the travel of paper web in the calender. The successive nips in the calender that affect the properties of the surface of the web are thus always formed between a roll 14 having a flexible shell and a heated roll 4 having a rigid shell.

The paper web W to be calendered is brought in the form of rolls 6 to an unwinder 15 belonging to the calendering process. The paper web has been moistened in the paper machine before the reeling up of the reel 6 to an optimal moisture content of 1 to 10%, advantageously 4 to 7%. From the reel 6 the web W is run in the direction of the arrow A to be moistened by means of the pre-moisturizer 8 before it is guided via guiding rolls 5 to the first nip N1 of the first set of rolls 2 of the multinip calender. In this embodiment of the invention the nip N1 is the lowermost nip in the set of rolls 2. From the nip N1 the web runs around the reversing roll 5 to the next upper nip N2. Thereafter the paper web travels around the reversing roll 5 and through the nip N3 and forward, until the web has been passed through the uppermost nip N4 of the first set of rolls 2. Thereafter the paper web W is passed via an intermediate moisturizer 9 to the first nip N1' of the second set of rolls 3, which is the uppermost nip in the second set of rolls 3. Thereafter the web is passed around the reversing roll to the next lowermost nip N2', and further by means of the reversing rolls 5 to the nips N3' and N4'. The nip N4' is the lowermost nip in the second set of rolls 3, whereafter the web is run guided by the guide rolls 5 to be reeled into a full reel R.

The moisturizers, the pre-moisturizer 8 and the intermediate moisturizer 9 in the apparatus are positioned in close proximity of the surface of the web, against it in such a manner that the moistening medium sprayed from the moisturizer meets the surface of the web. The pre-moisturizer 8 is positioned in such a manner that the moistening of the web takes place when the web is supported against a supporting roll 7, wherein the web W is thus moistened only from one side S2 that is positioned against the pre-moisturizer 8. The pre-moisturizer is positioned in relation to the web in such a manner that the side of the web that has been moistened in the pre-moisturizer 8 ends up in contact with the heated thermoroll 4 having a hard surface in the first nip N1 of the first set of rolls. The intermediate moisturizer 9 is positioned after the first set of rolls 2 in such a manner that it moistens the other surface S1 of the web in the free draw before the web W is passed to the first nip N1' of the second set of rolls in the multinip calender. The moisturizers 8 and 9 are positioned in relation to the web in such a manner that the absorption time of the moistening water into the web is substantially the same on both sides of the web. The accurate location of the moisturizers is determined in accordance with the desired absorption time.

For the purpose of controlling the apparatus it is provided with a control unit 13 that controls the amount of moistening medium supplied by the moisturizers 8 and 9, and the nip pressures of the calender, as well as the temperature and profiles of the heated rolls 4. The control unit contains the calculation and control algorithms required by the control. In the control, feedback control utilizing multivariable control and/or model-based predictive control is used.

For the control the apparatus comprises measurement devices 10 and 11 for measuring the moisture content of the web, being positioned after the pre-moisturizer 8 and the intermediate moisturizer 9. The measurement devices are composed of measuring heads 10*a*, 10*b*, 11*a* and 11*b* positioned on both sides of the web, substantially at the same point of the web. The measuring heads are attached to a measurement beam (not shown in the figure) extending across the width of the web in which they travel back and forth, measuring the web continuously. The moisture data measured by the measurement devices 10 and 11 is transmitted to the control unit 13 that calculates the control signals B and C necessary for adjusting the amount of moistening medium from the moisture data, and transmits them to the moisturizers 8 and 9. The apparatus is also provided with a third measurement device 12 positioned after the multinip calender 1, before the reeling of the calendered web, said measurement device measuring at least the caliper and gloss of the web. These measurement results are used for controlling the multinip calender 1. In other words, the values measured by the measurement device 12 are transmitted to the control unit 13 that calculates the necessary control signals D by means of which the nip pressures of the nips in the multinip calender 1 and the temperature of the heated rolls 4 are adjusted. The measurement of the different properties of the paper web and the measurement devices used in the measurements are known as such by a person skilled in the art, and therefore they are not described in more detail in this context.

Figure 2:
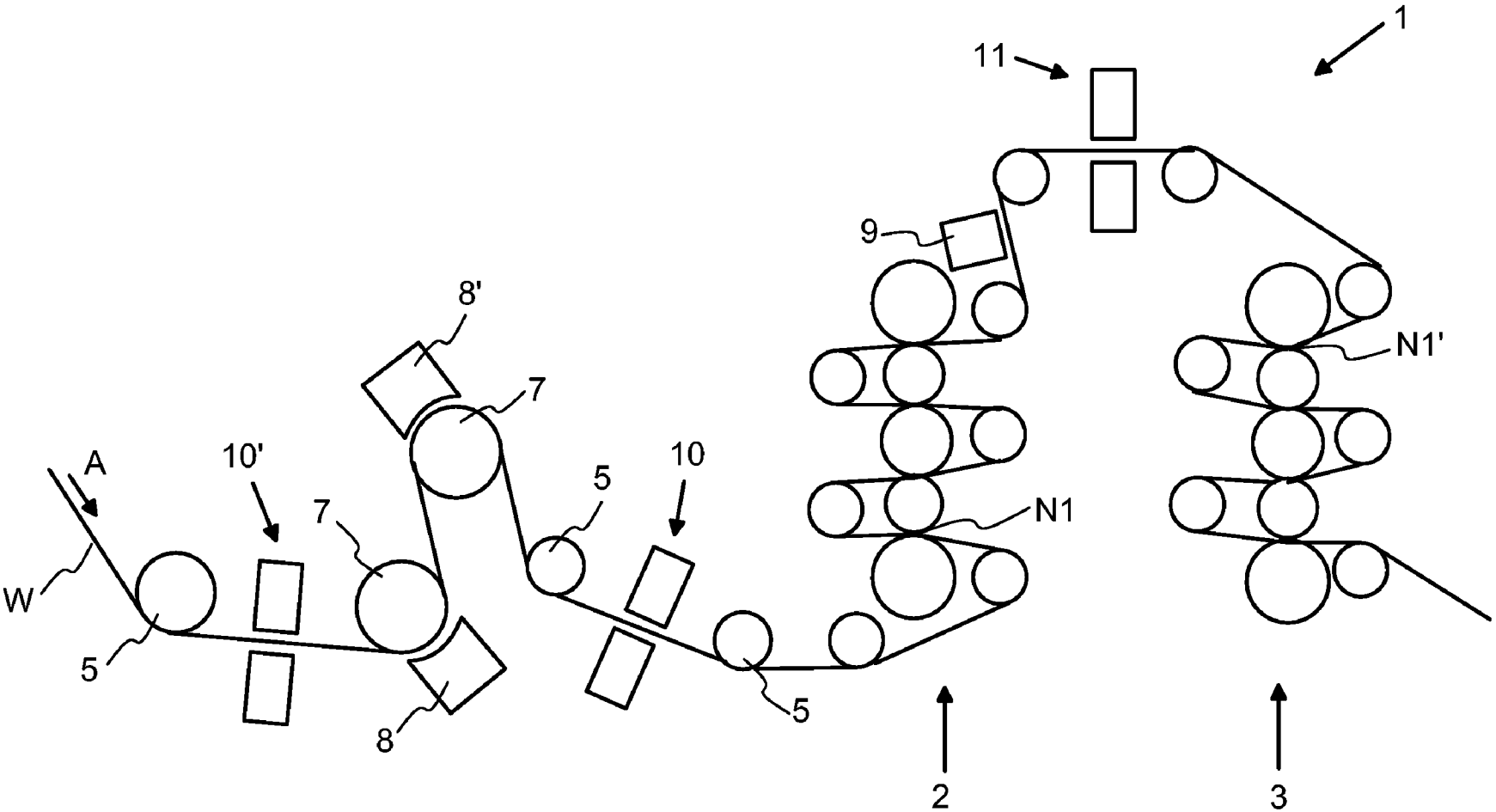
FIG. 2 shows a schematic side view of a second apparatus according to the invention.

FIG. 2 shows an apparatus comprising a multinip calender 1 composed of two sets of rolls, similar to the one shown in FIG. 1. In this embodiment, the apparatus comprises two pre-moisturizers 8 and 8', which moisten both sides of the web before the web is passed to the first nip N1 of the first set of rolls 2 of the multinip calender 1. Both pre-moisturizers are arranged to moisten the web supported by supporting rolls 7. The apparatus also contains an intermediate moisturizer 9 positioned after the first set of rolls 2 of the multinip calender in such a manner that it moistens the second surface of the web before the web W is passed to the first nip N1' of the second set of rolls 3 in the multinip calender.

For the purpose of adjusting the apparatus the apparatus comprises a measurement device 10' positioned before the first pre-moisturizer 8 in the travel direction of the web, said measurement device measuring the moisture content of the web before the pre-moisturizers 8 and 8' Furthermore, the apparatus comprises a measurement device 10 arranged to measure the moisture content of the web after the pre-moisturizers 8 and 8', and a measurement device 11 that measures the moisture content of the web after the intermediate moisturizer 9. The moisture data of the web obtained from the above-mentioned measurement devices is used for controlling the moisturizers 8, 8' and 9. In the control of the moisturizers a control unit (not shown in the figure) is used, as shown in FIG. 1.

Figure 3A:
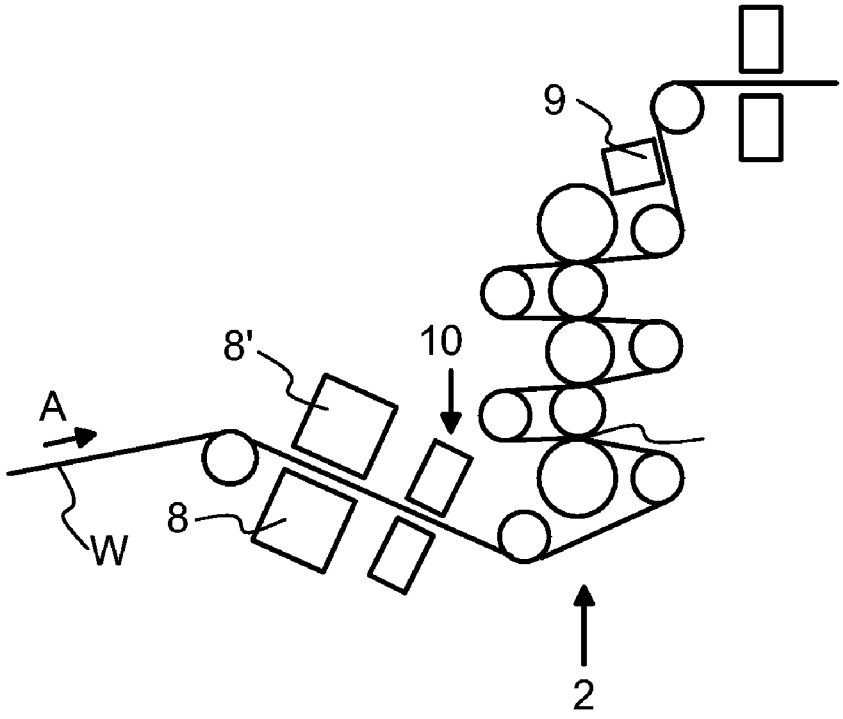
FIGS. 3*a* and 3*b* show schematic side views of the embodiments of placing a pre-moisturizer and an intermediate moisturizer in an apparatus according to the invention.
Figure 3B:
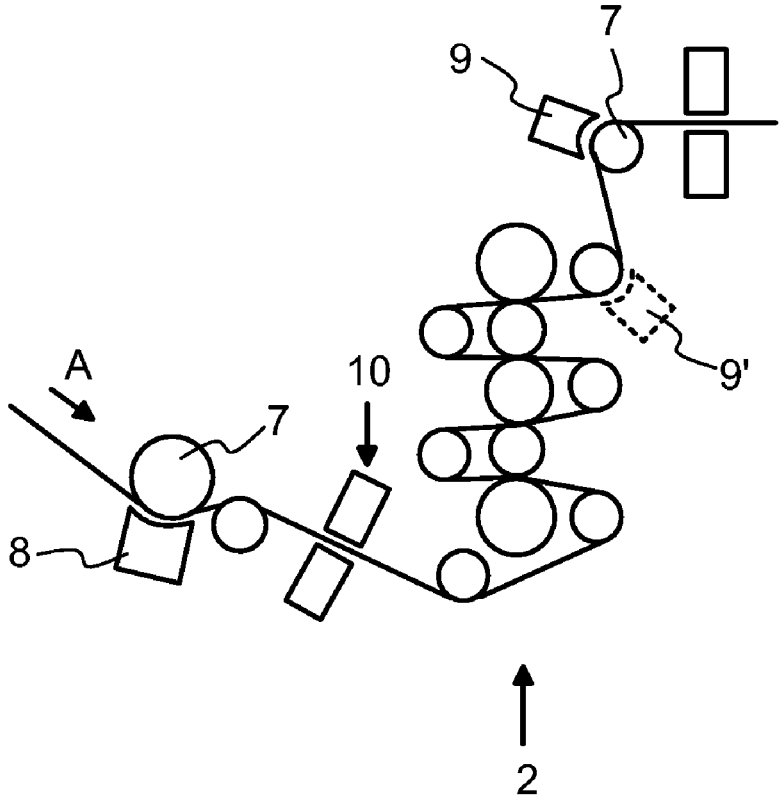

As disclosed above, the moisturizers can be arranged in the apparatus in such a manner that they moisten the web either when it is supported against a suitable supporting surface, such as a supporting roll, or when the web travels without support. As a supporting surface it is also possible to use a supporting plate installed in a suitable manner. FIGS. 3*a* to 3*b* show two alternative ways of positioning the pre-moisturizers and intermediate moisturizers in the multinip calender. In FIG. 3*a*, two pre-moisturizers 8 and 8' are positioned on both sides of the web W before the first nip N1 of the first set of rolls 2 of the multinip calender in such a manner that they moisten substantially the same point of the web. The intermediate moisturizer 9 positioned after the first set of rolls 2 moistens one side of the web. In FIG. 3*b* the intermediate moisturizer 9 is positioned after the first set of rolls 2 to moisten the web W supported against the supporting roll 7. The premoistening of the web takes place by means of one pre-moisturizer 8 that moistens the opposite side of the web. If desired, the intermediate moisturizer can be positioned to moisten the same side of the web supported by a supporting roll as the pre-moisturizer 8. Such an intermediate moisturizer 9' is drawn in broken lines in FIG. 3*b*. It is also possible to use both intermediate moisturizers 9 and 9' for moistening the web.

Figure 4:
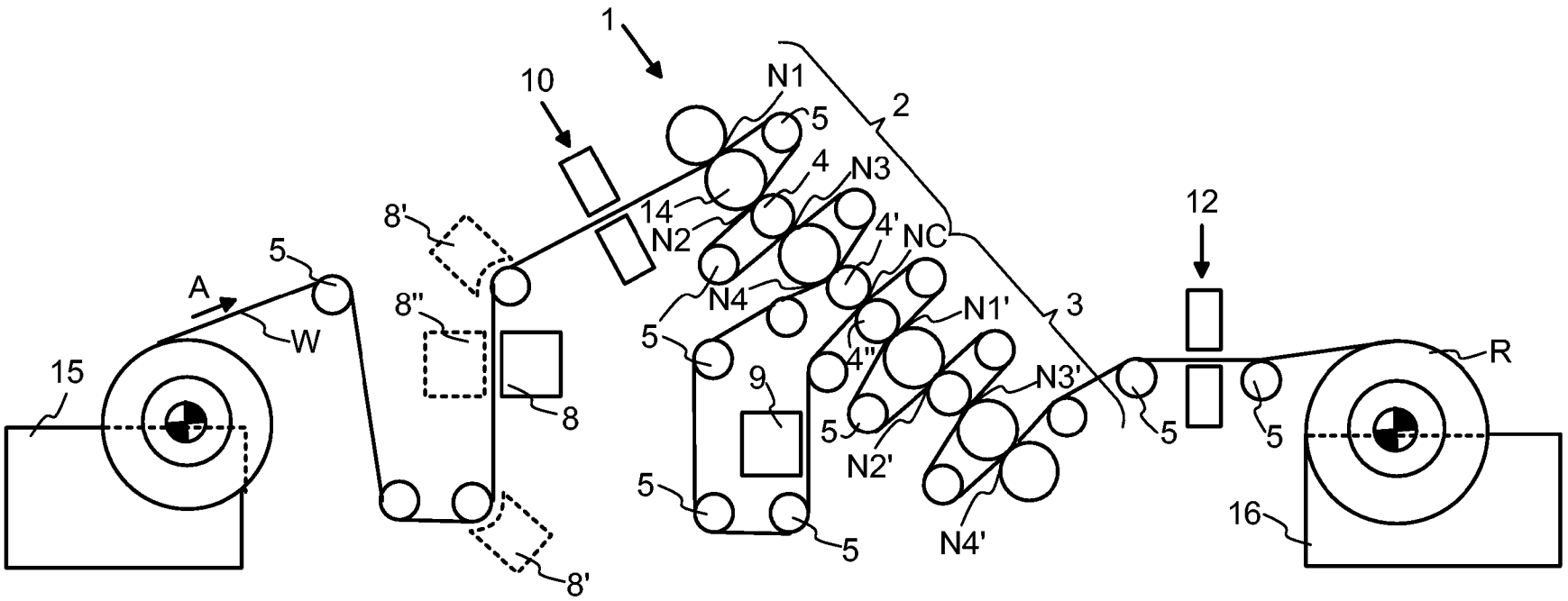
FIG. 4 shows a side view of a third apparatus according to the invention.

FIG. 4 shows an embodiment of the invention in which a multinip calender 1 having 9 nips is arranged in a slightly oblique position with respect to the horizontal plane. By means of this arrangement it is possible to reduce the height of the multinip calender and it can be placed in a lower mill hall than a calender installed in an upright position. The multinip calender 1 is formed in such a manner that it comprises two sets of rolls, a first set of rolls 2 and a second set of rolls 3 that are arranged successively in such a manner that the lower roll 4' of the first set of rolls and the upper roll 4" of the second set of rolls form a shared nip NC between the sets of rolls. The web W is unwound from the reel 6 by means of an unwinder 15, and passed by means of guide rolls 5 to be moistened by means of the pre-moisturizer 8 before it is guided to the first, uppermost nip N1 of the first set of rolls 2 of the multinip calender 1. From the nip N1 the web is passed around the reversing roll 5 to the next lower nip N2. Thereafter the paper web runs around the reversing roll 5 and through the nip N3 and forward, until the web has been passed through the lowermost nip N4 of the first set of rolls 2. After the nip N4 the paper web W is passed via the guide rolls 5 to be moistened by the intermediate moisturizer 9. Thereafter the web is passed via the nip NC shared by the sets of rolls 2 and 3 and formed by the lowermost roll 4' of the first set of rolls 2 and the uppermost roll 4" of the second set of rolls 3 to the first nip N1' of the second set of rolls 3, which is the uppermost nip of the second set of rolls 3. Thereafter the web is passed around the reversing roll 5 to the next lower nip N2', and further by means of the reversing rolls to the nips N3' and N4'. After the nip N4' the paper web W is passed via the guide rolls 5 to be reeled by the reel-up 16 to form a full reel R.

The pre-moisturizer 8 and the intermediate moisturizer 9 are positioned in such a manner that they both moisten different sides of the web and that the absorption time of the moistening medium into the web is substantially the same on both sides of the web. It is, of course, possible to position pre-moisturizers and intermediate moisturizers in the apparatus so that they also moisten the web travelling against the roll, as shown by pre-moisturizers 8' drawn in broken lines. It is also possible to moisten both sides of the web substantially at the same point by using two pre-moisturizers, a pre-moisturizer 8 drawn in solid lines and a pre-moisturizer 8' drawn in broken lines.

Figure 5:
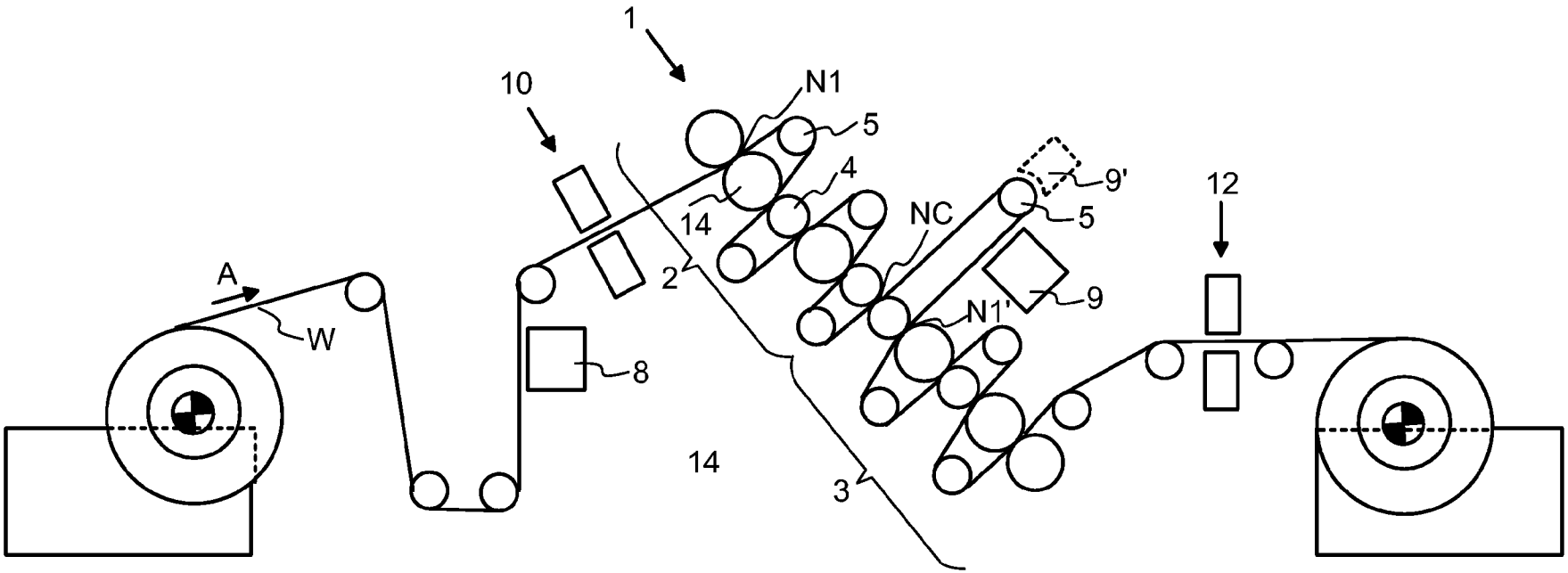
FIG. 5 shows a side view of a fourth apparatus according to the invention.

FIG. 5 also shows an embodiment of the invention in which the first set of rolls 2 and the second set of rolls 3 forming the multinip calender 1 are arranged successively in such a manner that they form a shared nip NC between the sets of rolls. The multinip calender 1 is arranged in an oblique position in this embodiment as well. The web W is passed via the pre-moisturizer 8 to the first nip N1 of the first set of rolls 2 of the multinip calender 1, and further therefrom through the first set of rolls, and further through the shared nip NC between the first set of rolls 2 and the second set of rolls 3. Thereafter the web is passed around the reversing roll 5 to be moistened by the intermediate moisturizer 9, and further therefrom under the guidance of the reversing rolls 5 through the second set of rolls 3.

The pre-moisturizer 8 and the intermediate moisturizer 9 are positioned in such a manner that they both moisten different sides of the web. It is also possible to position the intermediate moisturizer in the apparatus so that it also moistens the web travelling against the roll, as shown by the pre-moisturizer 9' drawn in broken lines. In this embodiment, the intermediate moisturizer 9 is positioned in such a manner that the absorption time of the moistening medium sprayed into the web is shorter than that shown in the embodiment of FIG. 4.

Figure 6:
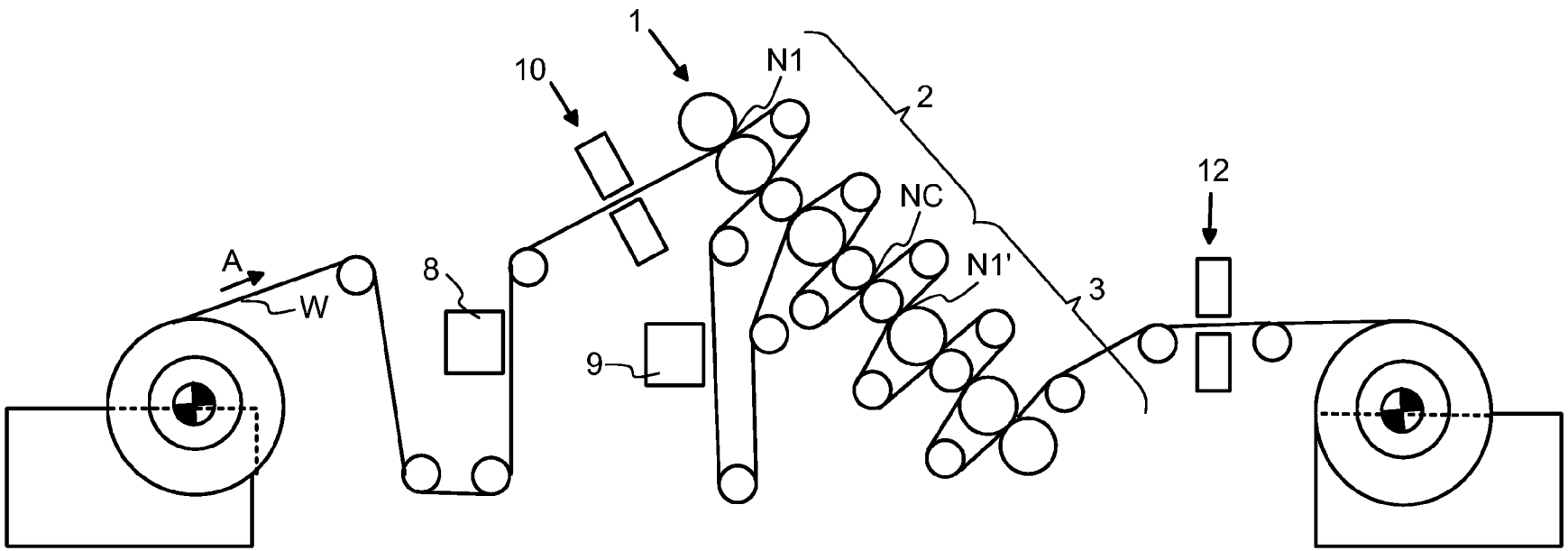
FIG. 6 shows a side view of a fifth apparatus according to the invention.

FIG. 6 shows an embodiment of the apparatus according to the invention. The web is moistened with a pre-moisturizer 8 before it is passed to the first nip N1 of the first set of rolls 2 in the multinip calender 1. The intermediate moisturizer 9 is positioned in such a manner that it moistens the web W after the second nip N2 of the first set of rolls 2.

For the purpose of adjusting the calender of the embodiments shown in FIGS. 4 to 6, the apparatus comprises measurement devices 10 that measure the moisture content of the web after premoistening, before the web is passed to the first nip N1 of the first set of rolls 2. The apparatus also comprises a measurement device 12 positioned after the multinip calender 1 for measuring the properties of the web. The measurement results obtained from the measurement devices are transmitted to the control unit of the calender (not shown in the figure), in which control signals necessary for controlling the calender are formed thereof in a manner described hereinabove.

The advantages attained by means of the invention can be found in the following table 2, which illustrates the improvement of the properties of SC-A paper calendered by means of an off-line multinip calender utilizing the gradient calendering process according to the invention when compared to similar SC-A paper (reference) having the same basis weight and other properties, but which has been calendered with an off-line calender of prior art.

TABLE 2

| Paper property | Reference | 1 pre-moisturizer and 1 intermediate moisturizer | 2 pre-moisturizers and 1 intermediate moisturizer |
|---|---|---|---|
| Roughness (μm) | 1.0-1.1 | 1.0-1.1 | 1.0-1.1 |
| Gloss (%) | 48-50 | 54-57 | 56-60 |
| Blackening | 48-58 | 46-54 | 44-53 |
| Oil absorption (g/m$^2$) | 4.5-6 | 3.5-5 | 3-4.5 |
| Porosity (ml/min) | 15-25 | 10-20 | 7-16 |
| Brightness (%) | 68 | 68 | 68 |
| Opacity (%) | 91 | 91 | 91 |

As can be seen in the Table 2, by means of a method and an apparatus according to the invention it is possible to attain significant improvements in view of gloss, blackening, oil absorption and porosity of paper, when compared to the reference.

The heated rolls, so-called thermorolls used in the multinip calender according to the invention can be made of any material suitable for the purpose, preferably they are made of cast steel or forged steel, which endure well the thermal load exerted thereto by the moistened paper. The temperature of the heated rolls that treat the surface of the web that is positioned against the roll and moistened before the calendering nip, should be at least 120° C.

The invention is not intended to be limited to the embodiments presented as examples above, but the invention is intended to be applied widely within the scope of the inventive idea as defined in the appended claims. Thus, it is also possible to form the multinip calender of superimposed calender rolls in such a manner that the travel direction of the web is from top to bottom in the first set of rolls 2 and/or in the second set of rolls 3. Furthermore, the number of pre-moisturizers and intermediate moisturizers disclosed in FIGS. 1 to 6 and their placement with respect to the paper web do not in any way restrict the scope of protection of the invention, but they can be selected according to the paper grade to be manufactured.

The invention claimed is:

1. A method of forming a calendered paper web comprising the steps of:

manufacturing and drying a paper web, moisturizing the dried paper web to a moisture content of 4-7% and reeling the paper web into a machine reel;

un-reeling the paper web and calendering the paper web in a multinip calender whose roll assembly is formed of a first set of rolls and a second set of rolls, the second set of rolls arranged after, and separate from the first set of rolls in a travel direction defined by the travel of the paper web, the paper web traveling over guide rolls between rolls of the first set of rolls and the second of rolls;

wherein the paper web is calendered in the first set of rolls arranged to form first successive nips between superimposed rolls having a flexible coating and heated metal rolls having a smooth surface following each other alternately in the travel direction;

wherein the paper web is calendered in the second set of rolls arranged to form second successive nips between superimposed rolls having a flexible coating and heated metal rolls having a smooth surface following each other alternately in the travel direction;

moisturizing one surface of the paper web with at least one pre-moisturizer and raising the paper web to a moisture content of 8-12%, and thereafter passing the paper web to a first calender nip of the first successive nips of the first set of rolls, and then through said first successive nips of the first set of rolls;

moisturizing an opposite surface of the paper web with at least one intermediate moisturizer and raising the paper web to a moisture content of 6-10%, and thereafter passing the paper web to a first calender nip of the second successive nips of the second set of rolls, and then through said second successive nips of the second set of rolls;

wherein the at least one pre-moisturizer is spaced from the first calender nip so that the travel of the paper web in the travel direction toward the first calender nip of the first successive nips of the first set of rolls defines a first absorption time of the moistening medium sprayed by the pre-moisturizer and wherein the intermediate moisturizer on the opposite surface of the paper web is spaced from the first calender nip of the second successive nips of the second set of rolls so that the travel of the paper web in the travel direction toward the first calender nip of the second set of rolls defines a second adsorption time substantially the same as the first adsorption time;

wherein the paper web is calendered to a roughness of 1.0-1.1 μm and a gloss of 54-57%.

2. A method of forming a calendered paper web comprising the steps of:

manufacturing and drying a paper web, moisturizing the dried paper web to a moisture content of 4-7% and reeling the paper web into a machine reel;

un-reeling the paper web and calendering the paper web in a multinip calender whose roll assembly is formed of a first set of rolls and a second set of rolls, the second set of rolls arranged after and separated from the first set of rolls in a travel direction defined by the travel of the paper web, the paper web traveling over guide rolls between rolls of the first set of rolls and the second of rolls;

wherein the paper web is calendered in the first set of rolls arranged to form first successive nips between superimposed rolls having a flexible coating and heated metal rolls having a smooth surface following each other alternately in the travel direction;

wherein the paper web is calendered in the second set of rolls arranged to form second successive nips between superimposed rolls having a flexible coating and heated metal rolls having a smooth surface following each other alternately in the travel direction;

moisturizing one surface of the paper web with one pre-moisturizer and using a second pre-moisturizer to moisturize a second opposite surface the paper web so that both sides of the web are pre-moisturized and raising the paper web to a moisture content of 8-12%, and thereafter passing the paper web to a first calender nip of the first successive nips of the first set of rolls, and then through said first successive nips of the first set of rolls;

moisturizing the second opposite surface of the paper web with at least one intermediate moisturizer and raising the paper web to a moisture content of 6-10%, and thereafter passing the paper web to a first calender nip of the second successive nips of the second set of rolls, and then through said second successive nips of the second set of rolls;

wherein the one pre-moisturizer is spaced from the first calender nip so that the travel of the paper web in the travel direction toward the first calender nip of the first successive nips of the first set of rolls defines a first absorption time of the moistening medium sprayed by the pre-moisturizer and wherein the intermediate moisturizer on the opposite surface of the paper web is spaced from the first calender nip of the second successive nips of the second set of rolls so that the travel of the paper web in the travel direction toward the first calender nip of the second set of rolls defines a second adsorption time substantially the same as the first adsorption time;

wherein the paper web is calendered to a roughness of 1.0-1.1 μm and a gloss of 56-60%.

3. The method according to claim 1, wherein the moisturizing of the paper web and the multinip calender are controlled by measuring moisture content or gloss of the paper web and adjusting pressure in the nip of the multinip calender and the heated rolls temperatures by a control unit on the basis of a control signal determined from said measuring moisture content or gloss of the paper web.

4. The method according to claim 1, wherein the first set of rolls and the second set of rolls comprise four nips or the first set of rolls and the second set of rolls comprise five nips.

5. The method according to claim 1, wherein the moisturizing of the paper web with the pre-moisturizer is preformed against a roll.

6. The method according to claim 1, wherein the moisturizing of the opposite surface of the paper web with at least one intermediate moisturizer is preformed against a roll.

7. An apparatus for calendering a paper web comprising:

an unwinder containing a first reel of a paper web with a moisture content of 4-7%;

a multinip calender following the unwinder and in paper web receiving relation to the first reel contained therein;

a reel-up containing a second reel in paper web receiving relation to the multinip calender;

the paper web extending from the first reel to the second reel;

wherein the multinip calender is formed of a first set of rolls and a second set of rolls, the second set of rolls arranged after and separate from the first set of rolls in a travel direction defined from the first reel to the second reel, the paper web extending over guide rolls between rolls of the first set of rolls and the second set of rolls;

wherein the paper web extends through first successive nips of the first set of rolls, the first successive nips being formed between superimposed rolls having a flexible coating and hot metal rolls having a smooth surface which follow each other alternately in the travel direction;

wherein the paper web extends through second successive nips of the second set of rolls, the second successive nips formed between superimposed rolls having a flexible coating and hot metal rolls having a smooth surface following each other alternately in the travel direction;

at least one pre-moisturizer positioned before the calender and arranged to moisturize a first surface of the paper web wherein a portion of the paper web immediately following the pre-moisturizer and extending to the multinip calender has a moisture content of 8-12%;

at least one intermediate moisturizer positioned between the first set of rolls and the second set of rolls of the calender and arranged to moisturize a second and opposite surface of the paper web, wherein a portion of the paper web immediately following the at least one intermediate moisturizer and extending to the second set of rolls has a moisture content of 6-10%;

wherein the at least one pre-moisturizer is spaced from a first calender nip of the first successive nips of the first set of rolls a selected distance, and wherein the at least one intermediate moisturizer on the opposite surface of the paper web is spaced from a first calender nip of the second successive nips of the second set of rolls substantially the same as the selected distance; and wherein the paper web following the multi-nip calender and extending to and forming the second reel has a roughness of 1.0-1.1 μm and a gloss of 54-57%.

8. An apparatus for calendering a paper web comprising:

an unwinder containing a first reel of a paper web with a moisture content of 4-7%;

a multinip calender following the unwinder and in paper web receiving relation to the first reel contained therein;

a reel-up containing a second reel in paper web receiving relation to the multinip calender;

the paper web extending from the first reel to the second reel;

wherein the multinip calender is formed of a first set of rolls and a second set of rolls, the second set of rolls arranged after and separated from the first set of rolls in a travel direction defined from the first reel to the second reel, the paper web extending over guide rolls between rolls of the first set of rolls and the second set of rolls;

wherein the paper web extends through first successive nips of the first set of rolls, the first successive nips being formed between superimposed rolls having a flexible coating and hot metal rolls having a smooth surface which follow each other alternately in the travel direction;

wherein the paper web extends through second successive nips of the second set of rolls, the second successive nips formed between superimposed rolls having a flexible coating and hot metal rolls having a smooth surface following each other alternately in the travel direction;

one pre-moisturizer positioned before the calender to moisturize a first surface of the web and a second pre-moisturizer positioned before the calender and arranged to moisturize a second opposite surface of the paper web arranged with the at least one pre-moisturizer to moisturize the paper web so that both sides of the web are pre-moisturized, the one pre-moisturizer and the second pre-moisturizer arranged to moisturize the surfaces of the paper web, wherein a portion of the paper web immediately following the pre-moisturizer and extending to the multinip calender has a moisture content of 8-12%;

at least one intermediate moisturizer positioned between the first set of rolls and the second set of rolls of the calender and arranged to moisturize the second and opposite surface of the paper web, wherein a portion of the paper web immediately following the at least one intermediate moisturizer and extending to the second set of rolls has a moisture content of 6-10%;

wherein the one pre-moisturizer is spaced from a first calender nip of the first successive nips of the first set of rolls a selected distance, and wherein the at least one intermediate moisturizer on the opposite surface of the paper web is spaced from a first calender nip of the second successive nips of the second set of rolls substantially the same as the selected distance; and wherein the paper web following the multi-nip calender, and extending to and forming the second reel has a roughness of 1.0-1.1 μm and a gloss of 56-60%.

9. The apparatus of claim 7, further comprising:

a plurality of moisture content or gloss measuring devices positioned before and after the multi-nip calender, and between the first set of rolls and the second set of rolls;

a control unit in control signal receiving relation to said plurality of moisture content or gloss measuring devices and in nip pressure adjusting relation to the multinip calender, and in temperature adjusting relation to the hot rolls of the first set of rolls and the hot rolls of the second set of rolls.

10. The apparatus of claim 7, wherein the first set of rolls and the second set of rolls comprise four nips or the first set of rolls and the second set of rolls comprise five nips.

11. The apparatus of claim 7, wherein the at least one pre-moisturizer is positioned opposite a roll.

12. The apparatus of claim 7, wherein the at least one intermediate moisturizer is positioned opposite a roll.

* * * * *

UNITED STATES PATENT AND TRADEMARK OFFICE

CERTIFICATE OF CORRECTION

PATENT NO. : 7,387,064 B2
APPLICATION NO. : 10/598664
DATED : June 17, 2008
INVENTOR(S) : Linnonmaa et al.

It is certified that error appears in the above-identified patent and that said Letters Patent is hereby corrected as shown below:

ON THE TITLE PAGE PLEASE DELETE - *ASSISTANT EXAMINER* – "Shauna L. Zimmerman" AND INSERT – *ASSISTANT EXAMINER* -- Dana Ross --

Signed and Sealed this

Fifth Day of May, 2009

JOHN DOLL
*Acting Director of the United States Patent and Trademark Office*